US006041459A

United States Patent [19]

Nunez et al.

[11] Patent Number: 6,041,459

[45] Date of Patent: Mar. 28, 2000

[54] CONVOLUTED FOAM CUSHION

[75] Inventors: Antonio Nunez, Flemington, N.J.; Bob A. Steelman, Richmond, Va.

[73] Assignee: The Spring Air Company, Des Plaines, Ill.

[21] Appl. No.: 08/943,846

[22] Filed: Oct. 3, 1997

[51] Int. Cl.[7] ..... A47C 17/00

[52] U.S. Cl. ..... 5/730; 5/901; 5/903; 5/740

[58] Field of Search ..... 5/901, 903, 740, 5/727, 953

[56] References Cited

U.S. PATENT DOCUMENTS

| | | |
|---|---|---|
| D. 316,202 | 4/1991 | Farley . |
| D. 352,858 | 11/1994 | Farley . |
| D. 383,349 | 9/1997 | Steelman et al. . |
| 2,902,091 | 9/1959 | Dahle . |
| 3,197,357 | 7/1965 | Schulpen . |
| 3,311,007 | 3/1967 | McGee . |
| 3,431,802 | 3/1969 | Schulpen . |
| 3,690,203 | 9/1972 | Huttemann . |
| 3,695,128 | 10/1972 | Gentile . |
| 3,730,031 | 5/1973 | Huttemann . |
| 3,828,378 | 8/1974 | Flam . |
| 4,335,476 | 6/1982 | Watkin . |
| 4,351,211 | 9/1982 | Azzolini . |
| 4,392,489 | 7/1983 | Wagner, Sr. . |
| 4,522,447 | 6/1985 | Snyder et al. . |
| 4,550,547 | 11/1985 | Wagner, Sr. . |
| 4,603,445 | 8/1986 | Spann . |
| 4,620,337 | 11/1986 | Williams et al. . |
| 4,672,700 | 6/1987 | Poncy . |
| 4,673,452 | 6/1987 | Awdhan . |
| 4,679,266 | 7/1987 | Kraft . |
| 4,686,724 | 8/1987 | Bedford . |
| 4,741,058 | 5/1988 | Williams et al. . |
| 4,879,776 | 11/1989 | Farley . |
| 4,955,095 | 9/1990 | Gerrick . |
| 5,010,609 | 4/1991 | Farley . |
| 5,038,433 | 8/1991 | Farley . |
| 5,077,849 | 1/1992 | Farley . |
| 5,111,542 | 5/1992 | Farley . |
| 5,136,740 | 8/1992 | Kraft . |
| 5,172,439 | 12/1992 | Farley . |
| 5,178,811 | 1/1993 | Farley . |
| 5,317,768 | 6/1994 | Klancnik . |
| 5,430,901 | 7/1995 | Farley . |

*Primary Examiner*—Michael F. Trettel
*Assistant Examiner*—James M Hewitt
*Attorney, Agent, or Firm*—Woods, Phillips, VanSanten, Clark & Mortimer

[57] ABSTRACT

An elongate convoluted cushion supports a recumbent human body. The cushion comprises an elongate rectangular body defined by seven rectangular, longitudinally spaced zones comprising alternating support zones and comfort zones. The support zones provide a first amount of support. The comfort zones provide a second amount of support. The first amount of support is greater than the second amount of support.

12 Claims, 4 Drawing Sheets

FIG. 3
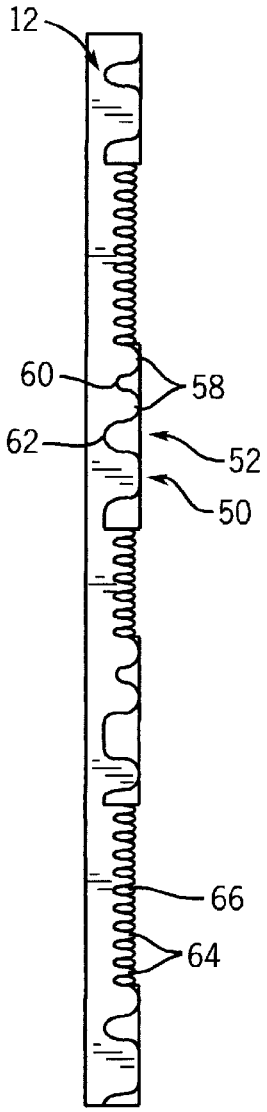
FIG. 4
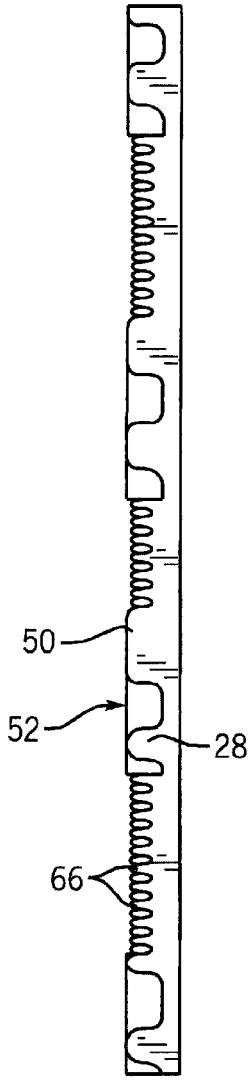
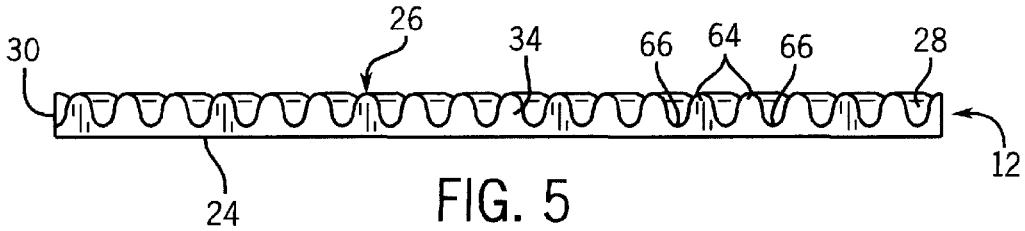
FIG. 5

CONVOLUTED FOAM CUSHION

FIELD OF THE INVENTION

This invention relates to an elongate cushion for supporting a recumbent human body and, more particularly, to a convoluted foam cushion.

BACKGROUND OF THE INVENTION

Various forms of convoluted foam cushions or pads have long been used for bedridden persons. A typical convoluted cushion has a flat bottom surface to rest on a suitable support, such as a mattress. The top surface is convoluted, rather than flat. More recently, convoluted foam cushions have been integrated into mattress designs to provide improved comfort and/or support. More particularly, a convoluted foam cushion may be better for circulation than traditional flat foam. The convoluted cushion reduces pressure points, resulting in less tossing and turning. Nevertheless, problems may remain due to the particular configuration of any given convoluted foam cushion. Advantageously, the cushion should provide better conformance to the human body than a traditional flat foam cushion. The various heights and depths found in various portions of the foam cushion must be selected to provide comfort and softness to the body, while adjusting to the anatomic shape of the body.

The present invention is directed to overcoming one or more of the problems discussed above in a novel and simple manner.

SUMMARY OF THE INVENTION

In accordance with the invention there is provided a convoluted foam cushion which increases comfort or softness.

Broadly, there is disclosed herein an elongate convoluted cushion for supporting a recumbent human body. The cushion comprises an elongate body including an area formed by generally longitudinally extending ribs arranged in rows. Each rib is separated from any adjacent rib by a channel. Each rib includes a plurality of first peaks having a first height and a plurality of second peaks having a second height, different from the first height. The first and second peaks are alternatingly disposed along each rib.

It is a feature of the invention that each rib is generally sinusoidal about a longitudinal axis to define sinusoidal channels therebetween. The first peaks are formed at crests of the sinusoidal ribs. The second peaks are formed at the longitudinal axis of each rib. The ribs are wider in areas proximate the first and second peaks. The first and second peaks are rounded.

It is another feature of the invention that the first height is greater than the second height. It is a further feature of the invention that the channels have a first thickness in areas proximate the first peaks and a second thickness in areas proximate the second peaks. The second thickness is greater than the first thickness.

There is disclosed in accordance with another aspect of the invention an elongate convoluted cushion for supporting a recumbent human body. The cushion comprises an elongate rectangular body defined by seven rectangular, longitudinally spaced zones comprising alternating support zones and comfort zones. The support zones provide a first amount of support. The comfort zones provide a second amount of support. The first amount of support is greater than the second amount of support.

It is a feature of the invention that the cushion is bidirectional.

It is another feature of the invention that the support zones are formed by generally longitudinally extending ribs arranged in rows, with each rib separated from any adjacent rib by a channel. Each rib includes a plurality of first peaks having a first height and a plurality of second peaks having a second height. The first and second peaks are alternatingly disposed along each rib.

It is an additional feature of the invention that the comfort zones are formed by a plurality of third peaks having a third height, the third peaks being arranged in rows. Each of the third peaks is separated from any adjacent third peak in a same row by a valley. The third peaks in adjacent rows are staggered to form a checkerboard pattern.

It is a further feature of the invention that the third peaks are rounded.

It is another feature of the invention that the second height is greater than the first height.

It is yet an additional feature of the invention that the valleys in the comfort zone have a thickness greater than a thickness of channels in the support zone.

Further features of the invention will be readily apparent from the specification and from the drawing.

BRIEF DESCRIPTION OF THE DRAWING

FIG. 3 is a left side view of the cushion of FIG. 2;

FIG. 4 is a right side view of the cushion of FIG. 2;

FIG. 5 is a head end view of the cushion of FIG. 2;

DETAILED DESCRIPTION OF THE INVENTION

Figure 1:
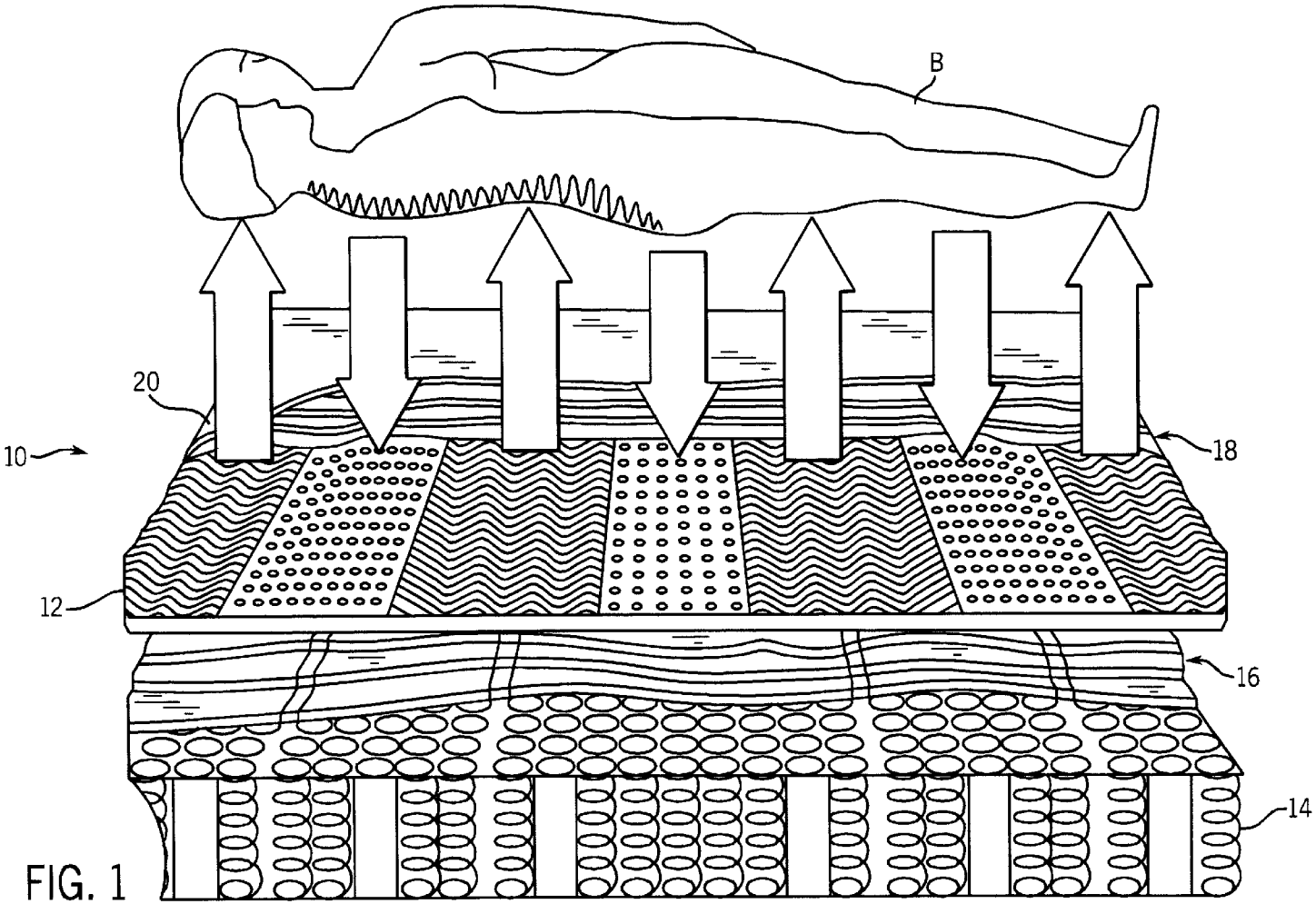
FIG. 1 is an exploded, partial perspective view, with parts removed for clarity, of a mattress including an elongate convoluted cushion according to the invention.
Figure 2:
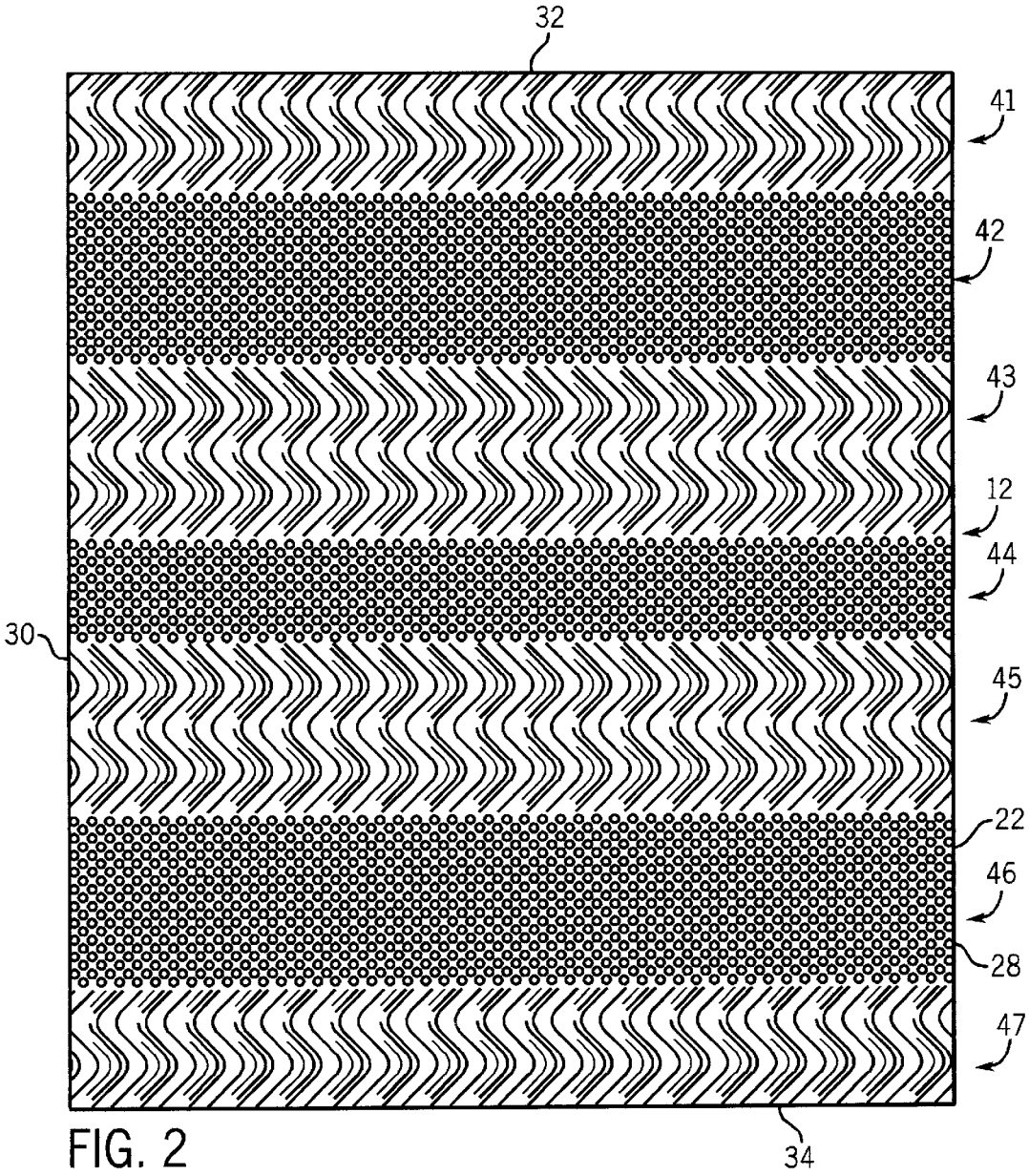
FIG. 2 is a plan view of the convoluted cushion of the mattress of FIG. 1.

Referring initially to FIG. 1, there is illustrated a mattress 10 including a convoluted foam pad or cushion 12 according to the invention. Overall, the mattress 10 is generally conventional in construction and includes an innerspring unit 14. A plurality of fiber layers 16 rest on the innerspring 14. The cushion 12 sits on the fiber layers 16. Several additional fiber layers 18 are disposed between the cushion 12 and a cover fabric layer 20. As is apparent, the cover fabric layer 20 surrounds the entire mattress 10.

The cushion 12 is configured to provide comfort and support to a human body, represented at B, by adjusting to the anatomic shape of the body B. Particularly, the cushion 12 is divided into seven zones having select convoluted pattern configurations. This is particularly illustrated in FIG. 1 with arrows pointing upward in positions where the cushion 12 provides additional support, and arrows pointing downward in positions where the cushion 12 is adapted for comfort.

As is apparent, the cushion 12 can be used in various mattress configurations. The particular configuration illustrated in FIG. 1 is but one example of such a mattress. Also, the cushion 12 could be provided as a separate unit which can be selectively placed atop a mattress. Thus, the invention is directed specifically to the configuration of the cushion 12.

Referring to FIGS. 2–5, the cushion 12 is illustrated in greater detail. The cushion 12 comprises an elongate rectangular body 22 including a generally flat bottom surface 24 and convoluted top surface 26. The body 22 is cut at opposite side edges 28 and 30 and opposite ends 32 and 34.

The body 22 is defined by seven rectangular zones 41, 42, 43, 44, 45, 46 and 47. The zones 41–47 are longitudinally spaced. The width of each zone corresponds to the width of the body 22. The zones 41, 43, 45 and 47 comprise support zones. The zones 42, 44 and 46 comprise comfort zones. The support zones 41, 43, 45 and 47 alternate with the comfort zones 42, 44 and 46. The support zones 41, 43, 45 and 47 provide a first amount of support. The comfort zones 42, 44 and 46 provide a second amount of support. Particularly, the first amount of support is greater than the second amount of support.

Figure 6:
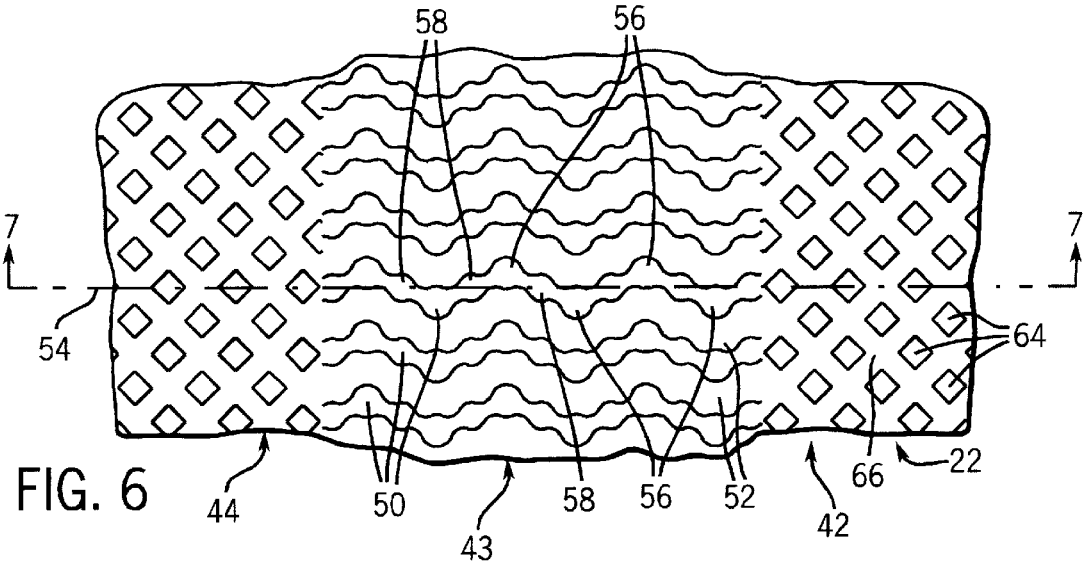
FIG. 6 is a partial, detailed view of a portion of the cushion of FIG. 2.
Figure 7:
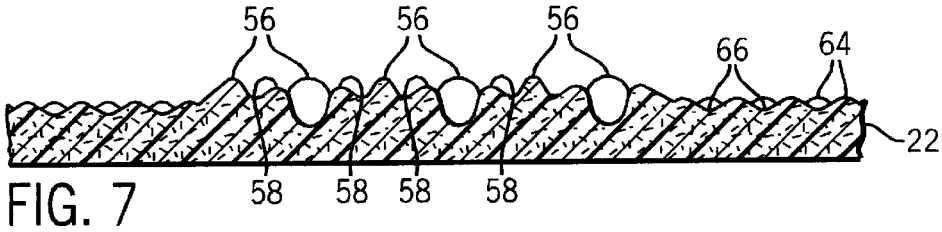
FIG. 7 is a sectional view taken along the line 7—7 of FIG. 6.

Referring now to FIGS. 6 and 7, a portion of the body 22 is illustrated in greater detail. Particularly, these figures illustrate portions of the support zone 43 and the opposite adjacent comfort zones 42 and 44. As is apparent, each of the support zones 41, 43, 45 and 47 are identical in construction. Likewise, the comfort zones 42, 44 and 46 are identical in construction. Thus, the description relative to the section shown in FIGS. 6 and 7 carries over to the zones throughout the entire cushion 12.

The support zone 43 includes a plurality of generally longitudinally extending ribs 50 arranged in rows. Each rib 50 is separated from any adjacent rib 50 by a channel 52. Each rib 50 is generally sinusoidal about a longitudinal axis. A representative longitudinal axis is indicated by a line 54 associated with one of the ribs 50. Thus, each of the channels 52 is likewise sinusoidal. Each rib includes a plurality of first peaks 56 and a plurality of second peaks 58. The first peaks 56 and second peaks 58 are alternately disposed along each rib 50. Particularly, the first peaks 56 are formed at crests of the sinusoidal ribs, i.e., the portion of each rib 50 furthest from the longitudinal axis 54. The second peaks 58 are formed at the longitudinal axis 54 of each rib 50. The ribs 50 are wider in areas proximate the peaks 56 and 58. The peaks 56 and 58 are generally rounded at their tops. The height of the first peaks 56 is greater than the height of the second peaks 58. The ribs 50 are wider in areas proximate the first peaks 56 than areas surrounding the second peaks 58.

The thickness of the body 22 at the channels 52 also varies alongside each rib 50. Particularly, referring to FIG. 3, the channel 52 includes a first channel portion 60 proximate the second peaks 58 and a second channel portion 62 proximate the first peaks 50. The cushion 12 is thicker at the first channel portion 60 than at the second channel portion 62.

The comfort zones, such as the comfort zone 42, is formed by a plurality of third peaks 64. The peaks 64 are arranged in longitudinal rows. Each of the third peaks 64 is longitudinally spaced from other peaks in the same row. Each of the adjacent rows is staggered to form a checkerboard pattern as illustrated. The third peaks 64 are also rounded at their tops, as illustrated in FIG. 7. The height of the third peaks 64 is lower than the height of the first peaks 56 and second peaks 58. The third peaks 64 are separated by valleys 66. The cushion at the valley 66 has a thickness greater than the thickness of the support zone channels 52.

In a typical mattress configuration, the first zone 41 provides support to the head and neck area. The second zone 42 provides comfort to the shoulder area. The third zone 43 provides support to the lower back area. The fourth zone 44 provides comfort to the hips and upper buttocks area. The fifth zone 45 provides support to the lower buttocks and thigh area. The sixth zone 46 provides comfort to the calf and leg area. Finally, the seventh zone 47 provides support to the lower leg, ankle and foot area. The fourth zone 44 is centrally positioned in the body 22. The third and fifth zones 43 and 45 are of identical size, as are the first and seventh zones 41 and 47. Also, the second and sixth zones 42 and 46 are of identical size. Thus, the cushion 22 is bidirectional. This allows the cushion 12 to be turned in the opposite longitudinal direction. Likewise, the mattress 10 can be periodically rotated on a regular basis.

The cushion 12 can be constructed of foam or one hundred percent latex. The cushion 12 provides for improved circulation and reduces pressure points, resulting in less tossing and turning. The cushion 12 provides better conformance than traditional foam. The peaks and valleys coupled with the softness of the cushion 12 provides an immediate response to the distribution of body weight and body pressure, therefore providing comfort and softness, while adjusting to the anatomic shape of the body. The use of the convolutions in the top surface 26 increases the comfort or softness of the resulting mattress 10. This is attributed to the various heights and depths found in the different zones, which provides a range of firmness within the mattress 10.

Particularly, the comfort zones 42, 44 and 46 are thinner in overall size. The support zones 41, 43, 45 and 47 are slightly raised. The increased thickness provides improved support. This higher support is attributed to the varying heights in the pattern. On average, the support zones 41, 43, 45 and 47 are thirty percent higher than the comfort zones 42, 44 and 46. The comfort zones assist in the overall comfort of the cushion 12. The firmness of the comfort zones 42, 44 and 46 are ten percent higher than in the support zones 41, 43, 45 and 47.

During the sleep cycle, the human body contains moisture. The convoluted pattern in the support zones 41, 43, 45 and 47 using the wave channel design provides ventilation which will eliminate moisture.

Thus, in accordance with the invention there is provided an improved convoluted cushion which adjusts to the anatomic shape of the body.

We claim:

1. An elongate convoluted cushion for supporting a recumbent human body, said cushion comprising:

an elongate rectangular body defined by seven rectangular longitudinally spaced zones comprising alternating support zones and comfort zones wherein the support zones provide a first amount of support, and wherein the comfort zones provide a second amount of support, with a thickness of the cushion in each zone determining the amount of support provided thereby, with thickness of the cushion in the support zones being greater than thickness of the cushion in the comfort zones so that the first amount of support is greater than the second amount of support, the seven zones comprising first, second, third, fourth, fifth, sixth and seventh zones, in order, the fourth zone being centrally located in the cushion, the first and seventh zones being of substantially similar size, the second and sixth zones being of substantially similar size and the third and fifth zones being of substantially similar size, whereby the cushion is bi-directional to provide substantially a same relative location of comfort zones and support zones in either longitudinal orientation of the cushion.

2. An elongate convoluted cushion for supporting a recumbent human body, said cushion comprising:

an elongate rectangular body defined by seven rectangular longitudinally spaced zones comprising alternating support zones and comfort zones wherein the support zones provide a first amount of support, and wherein the comfort zones provide a second amount of support, with a thickness of the cushion in each zone determining the amount of support provided thereby, with thickness of the cushion in the support zones being greater than thickness of the cushion in the comfort zones so that the first amount of support is greater than the second amount of support, wherein the support zones are formed by generally longitudinally extending ribs arranged in rows, with each rib separated from any adjacent rib by a channel, wherein each rib includes a plurality of first peaks having a first height and a plurality of second peaks having a second height, with the first and second peaks being alternatingly disposed along each rib.

3. The cushion of claim 2 wherein each rib is generally sinusoidal about a longitudinal axis to define sinusoidal channels therebetween.

4. The cushion of claim 3 wherein the first peaks are formed at crests of the sinusoidal ribs, and wherein the second peaks are formed at the longitudinal axis of each rib.

5. The cushion of claim 2 wherein the ribs are wider in areas proximate the first and second peaks.

6. The cushion of claim 2 wherein the first and second peaks are rounded.

7. The cushion of claim 2 wherein the first height is greater than the second height.

8. The cushion of claim 2 wherein the channels have a first thickness in areas proximate the first peaks and a second thickness in areas proximate the second peaks.

9. The cushion of claim 2 wherein the comfort zones are formed by a plurality of third peaks having a third height, the third peaks being arranged in rows, with each of the third peaks separated from any adjacent third peak in the same row by a valley, with the third peaks in adjacent rows being staggered to form a checkerboard pattern.

10. The cushion of claim 9 wherein the third peaks are rounded.

11. The cushion of claim 9 wherein the second height is greater than the third height.

12. The cushion of claim 11 wherein the valleys in the comfort zones have a thickness greater than thickness of channels in the support zone.

* * * * *